US010477299B2

(12) United States Patent
Christner et al.

(10) Patent No.: US 10,477,299 B2
(45) Date of Patent: Nov. 12, 2019

(54) LOUDSPEAKER SYSTEM WITH DIRECTIVITY

(71) Applicant: d&b audiotechnik GmbH, Backnang (DE)

(72) Inventors: Matthias Christner, Ludwigsburg (DE); Nico Paul, Remseck (DE)

(73) Assignee: d&b audiotechnik GmbH, Backnang (DE)

( * ) Notice: Subject to any disclaimer, the term of this patent is extended or adjusted under 35 U.S.C. 154(b) by 51 days.

(21) Appl. No.: 15/838,518

(22) Filed: Dec. 12, 2017

(65) Prior Publication Data

US 2018/0167722 A1 Jun. 14, 2018

(30) Foreign Application Priority Data

Dec. 12, 2016 (DE) ..... 10 2016 124 084

(51) Int. Cl.

| | |
|---|---|
| ***H04R 3/12*** | (2006.01) |
| ***H04R 1/02*** | (2006.01) |
| ***H04R 1/28*** | (2006.01) |
| ***H04R 3/04*** | (2006.01) |
| ***H04R 1/26*** | (2006.01) |

(Continued)

(52) U.S. Cl.

CPC ..... *H04R 1/2811* (2013.01); *H04R 1/02* (2013.01); *H04R 1/26* (2013.01); *H04R 1/2815* (2013.01); *H04R 1/403* (2013.01); *H04R 3/04* (2013.01); *H04R 3/12* (2013.01); *H04R 27/00* (2013.01); *H04R 1/026* (2013.01); *H04R 1/2819* (2013.01); *H04R 3/14* (2013.01); *H04R 2201/025* (2013.01)

(58) Field of Classification Search

CPC ..... H04R 1/2811; H04R 27/00; H04R 1/403; H04R 1/26; H04R 3/12; H04R 3/04; H04R 1/2815; H04R 1/02; H04R 2201/025; H04R 1/2819; H04R 1/026; H04R 3/14

See application file for complete search history.

(56) References Cited

U.S. PATENT DOCUMENTS

| | | | |
|---|---|---|---|
| 5,887,068 | A | 3/1999 | Givogue et al. |
| 2005/0047622 | A1 | 3/2005 | Graber |

(Continued)

FOREIGN PATENT DOCUMENTS

| | | | |
|---|---|---|---|
| CN | 201995113 | U | 9/2011 |
| CN | 203399269 | U | 1/2014 |

(Continued)

OTHER PUBLICATIONS

Translation of JP-2005295455, 2005, ITO et al.*

(Continued)

*Primary Examiner* — Brian Ensey

(74) *Attorney, Agent, or Firm* — Cooper Legal Group, LLC

(57) ABSTRACT

A loudspeaker system includes a loudspeaker enclosure having a front and a rear. Further, the loudspeaker system includes at least one first bass sound source, arranged in the loudspeaker enclosure, having a main direction of radiation at the front and at least one treble and/or midrange sound source. At least one first chamber of the loudspeaker enclosure is provided with a first sound exit opening that is at the side in regard to the main direction of radiation. The loudspeaker system further comprises at least one first directivity bass sound source that is arranged in the first chamber.

14 Claims, 6 Drawing Sheets

(51) Int. Cl.

| | |
|---|---|
| ***H04R 1/40*** | (2006.01) |
| ***H04R 27/00*** | (2006.01) |
| *H04R 3/14* | (2006.01) |

(56) References Cited

U.S. PATENT DOCUMENTS

| | | | | |
|---|---|---|---|---|
| 2006/0182298 | A1 | 8/2006 | Stiles et al. | |
| 2018/0367939 | A1* | 12/2018 | Fischer | H04R 1/26 |

FOREIGN PATENT DOCUMENTS

| | | | |
|---|---|---|---|
| JP | 2005295455 | | 10/2005 |
| WO | 2016044616 | A1 | 3/2016 |

OTHER PUBLICATIONS

Office Action cited in DE Application No. 10 2016 124 084.2 dated Oct. 12, 2017, pp. 1-6.
Translation of Chinese Office Action Application No. 201711316786.8 dated Mar. 28, 2019, 10 pgs.

* cited by examiner

LOUDSPEAKER SYSTEM WITH DIRECTIVITY

RELATED APPLICATION

The application claims priority to German Patent Application 10 2016 124 084.2, filed on Dec. 12, 2016, which is incorporated herein by reference.

BACKGROUND

The disclosure relates to a loudspeaker system with directivity and to a method for operating such a loudspeaker system.

Loudspeaker systems having a bass sound source typically have only slight directivity. This can be attributed to lower frequencies in the audio frequency range having wavelengths that are comparable to or greater than the standard enclosure dimensions of the loudspeaker boxes. Sound at a frequency of 100 Hz has a wavelength of 3.43 m, for example. If the dimension of a loudspeaker box is distinctly below that, this frequency is radiated more or less omnidirectionally. If e.g. a radiation area of 90° (at −6 dB level relative to the main axis) is required, a loudspeaker box having a width of 1 m, for example, is no longer able to deliver this directivity in the horizontal plane below approximately 300 Hz.

BRIEF DESCRIPTION OF THE DRAWINGS

Embodiments and examples of the disclosure are explained in more detail below with reference to the drawings. Like reference symbols denote identical or similar parts. The positional relationships and size ratios depicted in the drawings can exemplarily be used as a disclosure basis for indications of dimension.

DETAILED DESCRIPTION

Figure 1:
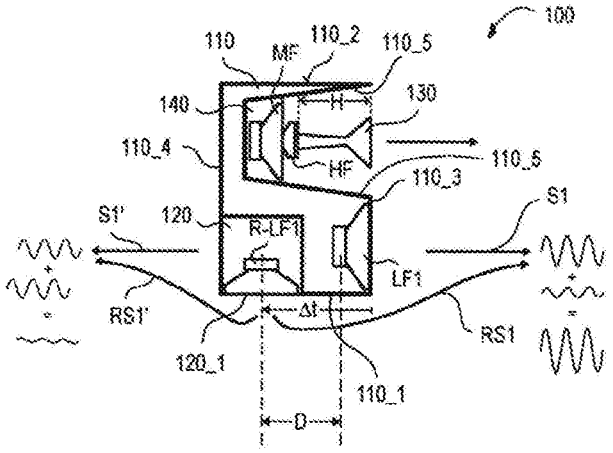
FIG. 1 is a schematic horizontal sectional depiction of a loudspeaker box of a loudspeaker system according to a first embodiment.

Embodiments of loudspeaker systems are described in an exemplary manner below. In this case, the term "loudspeaker system" in its most general meaning denotes the combination of loudspeaker box and electronics regardless of whether components of the electronics are arranged inside or outside the loudspeaker box. A loudspeaker box usually denotes the unit comprising loudspeakers and enclosure and also the further components present in or on the enclosure, such as, for example, wiring, frequency filter, damping materials, connector sockets, power amplifiers (in the case of what are known as self-powered systems), etc. In this respect, the term loudspeaker system in the meaning used here can mean just the loudspeaker box (with the components included in or on the loudspeaker box) or else the loudspeaker box (with the components included on or in the loudspeaker box) in combination with any external electronic components that are present.

Loudspeakers and/or electronic components that are denoted as "coupled" and/or "connected" below do not have to be coupled or connected directly to one another, but rather there may be intermediate elements present between the "coupled" or "connected" components. However, the terms "coupled" and/or "connected" are not intended to be restricted to this meaning, but rather may optionally also have the meaning that the components are coupled or connected to one another directly, i.e. without intermediate elements between the "coupled" or "connected" components.

In public address system engineering, specifically when providing sound coverage for large-capacity or open-air events, for example, it is desirable, however, to be able to use a loudspeaker to supply a defined audience area with sound pressure as uniformly as possible, specifically as uniformly as possible over the defined audience area and over preferably all the frequency bands relevant to the transmission (e.g. 40 Hz to 16 kHz). To this end, the directivity of the loudspeaker system should ideally be constant over the entire frequency range. This means that, particularly in the low frequency range, measures are desirable that increase the directivity of a loudspeaker system (for given enclosure dimensions).

Besides providing sound coverage as uniformly as possible for a defined audience area, increased directivity may also be important for noise control, since it reduces the emission of sound in undesirable directions. Moreover, increased directivity allows the radiation of sound at the rear to be reduced, making it possible to achieve lower sound exposure for a stage and, as a result, a higher maximum gain before the onset of feedback, for example.

In the case of subwoofers (i.e. pure bass sound sources), it is already known practice to use what are known as cardioid loudspeaker arrangements. Cardioid loudspeaker arrangements use a bass loudspeaker, arranged at the rear of the loudspeaker enclosure, that generates antiphase sound in relation to the sound radiated by the front, which antiphase sound causes cancellation of the sound component radiated backward by the bass loudspeaker at the front and amplification of the sound component radiated forward by the bass loudspeaker at the front.

An object on which the disclosure is based can be regarded as that of providing what is known as a full range loudspeaker system comprising at least one treble and/or midrange sound source and at least one bass sound source having improved directivity. Further, the disclosure is aimed at specifying a method for operating such a loudspeaker system.

Accordingly, an embodiment of a loudspeaker system can comprise a loudspeaker enclosure having a front and a rear and also at least one first bass sound source, arranged in the loudspeaker enclosure, having a main direction of radiation at the front. Further, the loudspeaker system can have at least one treble and/or midrange sound source. At least one first chamber of the loudspeaker enclosure may be provided with a first sound exit opening that is at the side in regard to the main direction of radiation. The first chamber may have at least one first directivity bass sound source arranged in it.

The integration of the first chamber having the first sound exit opening at the side into the loudspeaker enclosure and the arrangement of the first directivity bass sound source in this chamber can achieve the effect that the lateral sound radiated from the sound exit opening has a phase in amplitude such that it increases the directivity of the loudspeaker system.

The first directivity bass sound source may be arranged at a distance at the rear of the first bass sound source in regard to the main direction of radiation, and the at least one treble and/or midrange sound source may be arranged at approximately the same level as the first directivity bass sound source in regard to the main direction of radiation. The effect achieved by this is that the paths of travel of the sound from the treble and/or midrange sound source and the sound from the first directivity bass sound source in the main direction of radiation are of comparable length, which allows particularly simple audio signal control of the loudspeaker system.

In particular, the loudspeaker system can have a first transmission path, which is coupled to the treble and/or midrange sound source and the first directivity bass sound source, and can have a second transmission path, which is coupled to the first bass sound source. In this case, it is possible for an e.g. passive frequency filter, whose input is coupled to the first transmission path and whose outputs are coupled to inputs of the treble and/or midrange sound source and the first directivity bass sound source, to achieve an increase in the directivity of the loudspeaker system by means of, by way of example, a single audio signal channel for the treble and/or midrange sound source and the first directivity bass sound source.

In this case, the second transmission path of the loudspeaker system may be provided to accept an audio signal that has a time delay in relation to an audio signal that is provided for the first transmission path. This audio signal with a time delay for the second transmission path can be provided by a second audio signal channel.

The loudspeaker system may further have an HF horn and/or an MF horn that is/are coupled to a treble and/or midrange sound source. The HF (high frequency) horn and/or the MF (midrange frequency) horn can have a length equal to or greater than 0.3 or 0.4 or 0.5 times the depth of the loudspeaker enclosure. This allows an HF horn and/or an MF horn having a comparatively great length and hence good directivity and high efficiency to be used for the sound of the treble and/or midrange sound source.

The loudspeaker system can have a further chamber having a sound exit opening to the front of the loudspeaker enclosure, wherein a midrange sound source of the treble and/or midrange sound source is accommodated in the further chamber.

It is possible for a treble sound source of the treble and/or midrange sound source to be arranged coaxially in the main direction of radiation in relation to the midrange sound source. In this case, the treble and/or midrange sound source can have a maximally symmetrical radiation behavior.

According to a second embodiment, the at least one treble and/or midrange sound source may be arranged at approximately the same level as the first bass sound source in regard to the main direction of radiation.

In this case, the loudspeaker system can have a first transmission path that is coupled to the first directivity bass sound source and a second transmission path that is coupled to the treble and/or midrange sound source and the first bass sound source.

Such a loudspeaker system can have an e.g. passive frequency filter whose input is coupled to the first transmission path and whose outputs are coupled to inputs of the treble and/or midrange sound source and the first bass sound source. In this case, the second transmission path may be provided to accept an audio signal that has a time delay in relation to an audio signal that is provided for the first transmission path. In this embodiment too, it is therefore possible for all of the sound sources to be operated using a two-channel audio amplifier.

Embodiments of a loudspeaker system further have at least one second bass sound source, arranged in the loudspeaker enclosure, having a main direction of radiation at the front, at least one second chamber of the loudspeaker enclosure having a second sound exit opening that is at the side in regard to the main direction of radiation and a second directivity bass sound source that is arranged in the second chamber. A symmetrical design for the loudspeaker system can be achieved, the directivity of said loudspeaker system being increased again or at a maximum on account of the symmetry. In particular, this can be achieved by virtue of the first and second bass sound sources and/or the first and second directivity bass sound sources and/or the first and second chambers and/or the at least one treble and/or midrange sound source being embodied symmetrically in relation to a plane of the loudspeaker that runs in the main direction of radiation.

A method for operating a loudspeaker system can comprise generating a control signal (drive signal) for a treble and/or midrange sound source and a control signal (drive signal) for a first directivity bass sound source from a common first audio amplifier output signal using an e.g. passive frequency filter, wherein the treble and/or midrange sound source radiates in a main direction of radiation and the first directivity bass sound source radiates at the side of the main direction of radiation. Further, the method can comprise coupling a first bass sound source to a second audio amplifier output signal that has a time delay relative to the first audio amplifier output signal, wherein the first bass sound source radiates in the main direction of radiation and is arranged at a distance from the first directivity bass sound source in the main direction of radiation.

The time delay may be selected and/or selectable independently of frequency, but also in a manner dependent on frequency, an improvement in the directivity over the entire frequency range being achievable in the latter case.

A first option for selecting the time delay is for it to be chosen such that the sound of the first bass sound source and the sound of the first directivity bass sound source are overlaid coherently in the main direction of radiation. In this way, a maximum sound pressure in the main direction of radiation (i.e. a maximum gain) of the sound is produced in the main direction of radiation, i.e. forward. Another option is for the time delay to be chosen such that the sound of the first bass sound source and the sound of the first directivity bass sound source are overlaid incoherently in the contrary main direction of radiation. In this case, a minimum sound pressure (i.e. a maximum cancellation) of the sound in the contrary main direction of radiation, i.e. backward, is achievable. The time delay can also be selected such that a specifically desired, for example preferably constant, directivity is achieved over all frequencies.

According to FIG. 1, a first embodiment of a loudspeaker system 100 has a loudspeaker box that includes a loudspeaker enclosure 110 and multiple sound sources (loudspeakers). More precisely, the loudspeaker enclosure 110 has at least one treble and/or midrange sound source arranged in it, which is subsequently referred to as HF/MF. Further, the loudspeaker enclosure has at least one first bass sound source (bass loudspeaker) LF1 (LF: low frequency) and at least one first directivity bass sound source (directivity bass loudspeaker) R-LF1 in it.

HF/MF subsequently denotes a loudspeaker assembly that radiates frequencies in the high and midrange frequency range. It usually consists of (at least) one treble sound source (treble loudspeaker) HF and at least one midrange sound source (midrange loudspeaker) MF, but can also consist of (at least) one wideband sound source (wideband loudspeaker) that covers the entire high and midrange frequency range.

As shown by way of example in FIG. 1, HF may be coupled to an HF horn 130. MF and HF may be oriented coaxially in relation to one another, i.e. the main directions of radiation of HF and MF may be coaxial. This can be achieved by way of example by virtue of HF being arranged in front of MF centrally in the direction of sound radiation, see FIG. 1. Another option is for HF to be physically integrated into the driver of MF coaxially, as a result of which the HF horn 130 is routed e.g. out of a central hole in the driver of MF (not depicted). Further, as explained subsequently in even more detail, an MF horn may be present, for example in the form of an "HF horn in MF horn" arrangement, in which the MF horn laterally surrounds the HF horn.

LF1 is located in the front area of the loudspeaker enclosure 110 in the loudspeaker system 100. LF1 radiates in a main direction of radiation. The main direction of radiation of HF/MF runs preferably parallel to the main direction of radiation of LF1.

The loudspeaker enclosure 110 further comprises at least one first chamber 120 in which a directivity bass sound source (directivity bass loudspeaker) R-LF1 is arranged. The first chamber 120 has a sound exit opening 120_1 that allows a lateral exit of sound and, by way of example, may be provided in a first side wall 110_1 of the loudspeaker enclosure 110. The sound exit opening 120_1 may be oriented perpendicular to the main direction of radiation of LF1, for example, and, further, the main direction of radiation of R-LF1 can run parallel or coaxial to the orientation of the sound exit opening 120_1 (i.e. to a central axis of the sound exit opening 120_1, for example).

FIG. 1 depicts a horizontal section through the loudspeaker box, i.e. 110_1 and 110_2 denote opposite side walls of the loudspeaker enclosure 110, the reference symbol 110_3 denotes the front of the loudspeaker enclosure 110 and the reference symbol 110_4 denotes the rear of the loudspeaker enclosure 110. The first chamber 120 cuts off an air volume present inside the first chamber 120 from an air volume in the loudspeaker enclosure 110 by means of chamber walls, i.e. the chamber walls include no openings that open into the loudspeaker enclosure (bass enclosure) 110.

The loudspeaker enclosure 110 can further have a further chamber 140 in which MF (see FIG. 1) or HF/MF are arranged. The further chamber 140 likewise includes an air volume that is separated from the air volume in the loudspeaker enclosure 110 by chamber walls.

R-LF1 is arranged at a distance D from LF1 at the rear of LF1 in regard to the main direction of radiation. The distance D between R-LF1 and LF1 causes sound radiated by R-LF1 to require a longer acoustic path (path of travel) in order to arrive at a particular point at the front of the loudspeaker enclosure 110 than sound radiated by LF1 (sound from R-LF1 in the forward direction is denoted by RS1 in FIG. 1, while sound from LF1 in the forward direction is denoted by S1).

The sound RS1 from R-LF1 is intended to be used to control the radiation behavior of the loudspeaker system 100 and, by way of example, to produce a preferably constant directivity over the frequency range. For this purpose, the sound generation in the front bass sound source LF1 is delayed by a period Δt such that the sound S1 in the direction forward (i.e. in the main direction of radiation of LF1) is amplified with the directivity sound RS1 from R-LF1 and/or that the sound S1' from LF1 backward (i.e. contrary to the main direction of radiation of LF1) is canceled out to the maximum extent with the sound RS1' from R-LF1 backward.

While a maximum gain (i.e. a maximum sound pressure) forward is achieved by maximally coherent overlaying of S1 and RS1, maximum cancellation (i.e. a minimum sound pressure) backward is achieved by maximally incoherent overlaying of S1' with RS1'. The coherent overlaying of sound forward and the incoherent overlaying of sound backward are illustrated schematically in FIG. 1 by the overlaying of respective wave trains. The two conditions or a compromise between these two conditions can be selected by virtue of a suitable choice of Δt, i.e. the time delay in the control of LF1 relative to the control of R-LF1.

Along the main direction of radiation of LF1, the two bass sound sources LF1 and R-LF1 thus operate with high or maximum coherency and increase the sound pressure there. The decreasing coherency away from the main direction of radiation leads in this case to the desired directivity in the horizontal plane in the frequency range e.g. below approximately 300 Hz. At therefore allows the directivity of the loudspeaker system 100 to be selected, a frequency-dependent selection Δt(f), i.e. time delay Δt as a function of frequency f, also being possible.

In the case of the loudspeaker system 100 depicted in FIG. 1, HF/MF is likewise in the rear part of the loudspeaker enclosure 110, i.e. for example approximately at the same level as R-LF1 with respect to the main direction of radiation of LF1 (i.e. likewise around approximately the distance D behind LF1). As subsequently explained in even more detail, this allows the loudspeaker system 100 to be able to be operated using a total of just two amplifier channels and allows one amplifier channel to actuate HF/MF and R-LF1 together, for example via an e.g. passive frequency filter, while the other amplifier channel actuates LF1.

Figure 2:
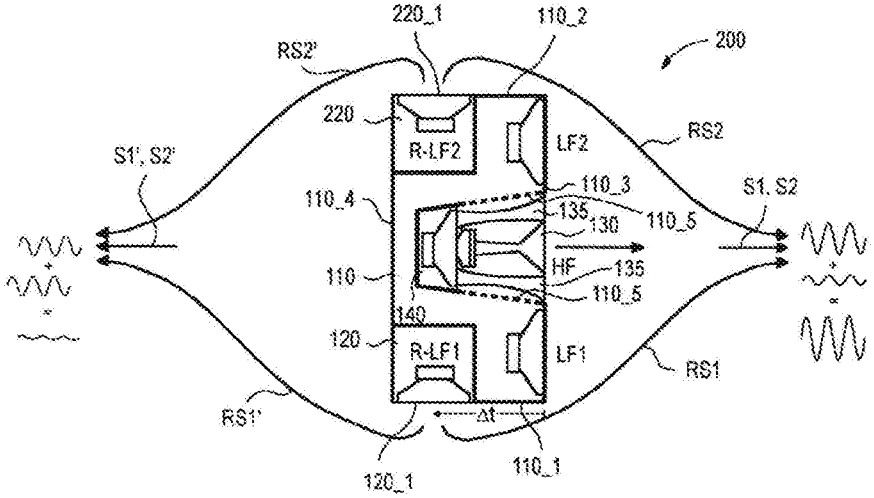
FIG. 2 is a schematic horizontal sectional depiction of a loudspeaker box of a loudspeaker system according to a symmetrical variant of the first embodiment.

FIG. 2 is an example of a loudspeaker system 200 according to a variant of the embodiment described above. The loudspeaker system 200 largely corresponds to the loudspeaker system 100, which is why reference is made to the description above to avoid repetition. The essential difference between the loudspeaker system 200 and the loudspeaker system 100 is that the loudspeaker system 200 has sound radiation that is symmetrical overall in the horizontal plane, this being achieved by virtue of, instead of a single pair comprising a bass sound source LF1 and a directivity bass sound source R-LF1, a further pair comprising a bass sound source LF2 and a directivity bass sound source R-LF2 is present in the loudspeaker enclosure 110. In this case, LF1 and LF2 and also R-LF1 and R-LF2 may be arranged symmetrically in relation to a vertical plane of the loudspeaker enclosure 110, in which plane the main direction of radiation of HF/MF can also run. The effect achieved by this is that symmetry in regard to the overall radiation behavior of the loudspeaker system 200 can be obtained over the entire frequency range in the horizontal plane.

The loudspeaker enclosure 110 of the loudspeaker system 200 therefore has, in addition to the subassemblies described in FIG. 1, a second chamber 220 having a second sound exit opening 220_1 that is at the side in regard to the main direction of radiation. A second directivity bass sound source (directivity bass loudspeaker) R-LF2 is arranged in the second chamber 220, the main direction of radiation of R-LF2 being able to run oppositely to the main direction of radiation of R-LF1, for example. Further, the loudspeaker enclosure 110 of the loudspeaker system 200 has a second bass sound source (bass loudspeaker) LF2 arranged in it, the main direction of radiation of which can run forward and e.g. parallel to the main direction of radiation of LF1.

The second chamber 220 likewise includes an air volume that is shut off from the interior of the loudspeaker enclosure 110, and can have an identical size to the first chamber 120, for example. In particular, with reference to a vertical enclosure plane situated in the main direction of radiation, LF2 may be arranged symmetrically in relation to LF1 and/or R-LF2 may be arranged symmetrically in relation to R-LF1 and/or the second chamber 220 may be arranged symmetrically in relation to the first chamber 120. The chambers 120, 220 may be embodied with or without lateral bass reflex openings. By way of example, bass reflex openings (not depicted) may be provided on the side walls 110_1 and 110_2 e.g. in the region of the rear corners of the chambers 120, 220 adjoining the rear wall 110_4.

LF1 and LF2 use the total available width of the loudspeaker enclosure 110 in order to attain the greatest possible directivity in regard to the enclosure dimension in the horizontal plane (LF1 and LF2 can use a common air volume in the interior of the loudspeaker enclosure 110). Nevertheless, without R-LF1 and/or R-LF2, the radiation angle would no longer be adequately controlled at low frequencies (e.g. below approximately 300 Hz) in accordance with the laws described at the outset. R-LF2 and R-LF1 are used to increase the directivity of the loudspeaker system 200, with the control of R-LF2 can be identical to the control of R-LF1 and the control of LF2 can be identical to the control of LF1. In a manner already described, this allows largely or maximally coherent overlaying of the forward sound S1 and RS1 from LF1 and R-LF1, respectively, and also largely or maximally coherent overlaying of the forward sound S2 and RS2 from LF2 and R-LF2, respectively, to be achieved. Likewise or alternatively, it is possible to obtain a largely or maximally incoherent overlaying of the backward sound S1' and RS1' from LF1 and R-LF1, respectively, and to obtain a largely or maximally incoherent overlaying of the backward sound S2' and RS2' from LF2 and R-LF2, respectively. Compromise solutions between these two conditions are naturally likewise possible, wherein in all cases an increase in the directivity of the loudspeaker system 200 is achieved that can be influenced by selection of a suitable time delay Δt between the control signals (drive signals) of LF1 and R-LF1 and by selection of a suitable time delay Δt between the control of LF2 and R-LF2. The time delay Δt for LF1 and R-LF1 may be identical to the time delay Δt for LF2 and R-LF2.

In the first embodiment, i.e. both in the case of a loudspeaker system 100 and in the case of the loudspeaker system 200, for example, the low installation position of HF/MF close to the rear wall 110_4 of the loudspeaker enclosure 110 means that the HF horn 130 can have a relatively great length H, for example a length that is equal to or greater than 0.3 or 0.4 or 0.5 times the depth of the loudspeaker enclosure 110 (which corresponds approximately to the length of the side walls 110_1 and 110_2). This allows a high level of directivity and a gain in efficiency for the sound in the high-frequency range. Further, the further chamber 140 and the MF arranged therein may likewise be arranged close to the rear wall 110_4 of the loudspeaker enclosure 110. By way of example, the further chamber 140 may be located completely in the rear half area of the loudspeaker enclosure 110. The positioning of the further chamber 140 close to the rear wall allows good directivity, e.g. as a result of sound baffles 110_5 of funnel-shaped depression in the loudspeaker enclosure 110, to be achieved for the sound in the midrange frequency range too.

An MF horn may be formed by these sound baffles 110_5 of the funnel-shaped depression, for example. It is also possible to realize an MF horn using e.g. multiple (in this case two) separate horn channels 135, which may be formed e.g. as plastic injection molded parts and, by way of example, are routed at the side next to the central HF horn 130 from MF to the front 110_3 of the loudspeaker enclosure 110. The horn channels 135 of the MF horn are—like the HF horn 130—subassemblies whose volume is shut off except for the sound opening at the front, and the sound baffles 110_5 can (optionally) be dispensed with in this case, see FIG. 2. The MF horn always allows a high level of directivity and a gain in efficiency for the sound in the midrange.

This is supplemented in the case of the loudspeaker system 200 depicted in FIG. 2 by the increase in the directivity as a result of the symmetrical arrangement of LF1/R-LF1 and LF2/R-LF2. In this way, it is possible to create a full range loudspeaker system 200 that can have a high level of directivity that is uniform (i.e. largely constant) over the entire frequency range. In particular, a loudspeaker system 200 can be created that has four (six) acoustic propagation paths (HF, MF, LF1, R-LF1, (LF2, R-LF2)) that are operated by means of just two amplifier channels. The control of the sound sources HF/MF, LF1, R-LF1, LF2, R-LF2 by means of just two amplifier channels can be effected as follows: since R-LF1 and R-LF2 are located approximately on an acoustic plane with HF/MF in regard to the main axis of the loudspeaker system 200, R-LF1, R-LF2 and HF/MF can be operated via an e.g. passive frequency filter on a (single) amplifier channel. The front bass sound sources LF1, LF2 can be actuated using a dedicated second amplifier channel and dedicated signal processing and can be delayed by Δt relative to the system comprising treble, midrange and lateral bass (i.e. HF/MF, R-LF1, R-LF2) according to their distance from the latter with regard to the main axis of radiation. That is to say, in other words, the laterally radiating R-LF1, R-LF2 causing the directivity in the bass frequency range can be passively placed onto the control signal (drive signal) for the treble and midrange frequency range HF/MF as well, since there is no propagation time problem between these sources on account of their arrangement on (approximately) the same propagation time plane.

A further advantage of such a loudspeaker system 200 is that a very even power balance can be achieved between the two amplifier channels. The reason is that LF1 and LF2 preferably need to be designed to be larger (i.e. more powerful) than R-LF1 and R-LF2, respectively, since the radiation from LF1 and LF2 is greater forward than backward. Therefore, the less powerful bass sound sources R-LF1, R-LF2 can be operated together with HF/MF by one amplifier channel, while the more powerful bass sound sources LF1, LF2 are operated by the other amplifier channel. This allows the two amplifier channels to be loaded to approximately the same extent in terms of power.

In other words, in the case of a 2- or 3-way system with front loudspeakers HF/MF (passively separated) and LF1 and LF2 (actively operated), an additional acoustic propagation path R-LF1 or R-LF2 is added at the side in each case to control the radiation behavior, the geometry and propagation times of said additional acoustic propagation path meaning that it can be passively coupled to the HF/MF front loudspeakers.

According to another perspective of the first embodiment, in the case of a passive 2- or 3-way system with subwoofers R-LF1 and R-LF2 oriented at the side, an additional active acoustic path LF1 or LF2 is added to control the radiation behavior, said additional active acoustic path being situated not on the acoustic plane of the passively operated loudspeakers or behind, however, but rather in front in the main direction of radiation.

As customary in engineering, in this case a 2-way system denotes a loudspeaker system that uses (passive) separation into two control (drive) signals (wideband and LF), whereas 3-way system denotes a loudspeaker system that performs (passive) separation into three control (drive) signals (HF and MF and LF). Throughout the disclosure, drive signals are signals for actuating the corresponding sound sources, e.g. HF, MF, LF.

For the loudspeaker system 100 shown in FIG. 1, most of the explanations above apply analogously, particularly the explanations pertaining to the physical embodiment of HF/MF and good control of the directivity of the HF/MF sound on account of the low installation position in the loudspeaker enclosure 110, the two amplifier channels and pertaining to the even power balance thereof.

Figure 3:
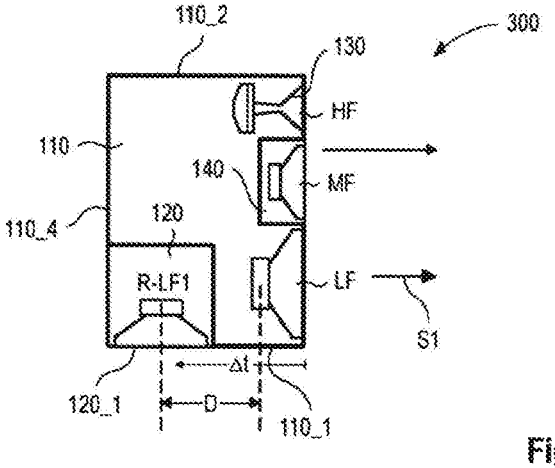
FIG. 3 is a schematic horizontal sectional depiction of a loudspeaker box of a loudspeaker system according to a second embodiment.
Figure 4:
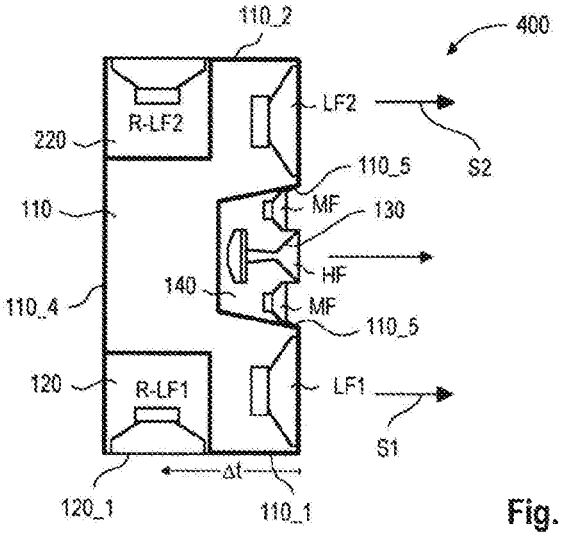
FIG. 4 is a schematic horizontal sectional depiction of a loudspeaker box of a loudspeaker system according to a symmetrical variant of the second embodiment.

FIGS. 3 and 4 are loudspeaker systems 300 and 400 according to a second exemplary embodiment. The loudspeaker systems 300 and 400 differ from the loudspeaker systems 100 and 200 essentially by virtue of the following features:

- In the loudspeaker systems 300, 400, HF/MF is arranged in a common acoustic plane with LF1 (and in the case of loudspeaker system 400 also with LF2). In other words, HF/MF is no longer arranged close to the rear wall 110_4 on the acoustic plane of R-LF1 (and in the case of the loudspeaker system 400 of R-LF2), but rather is arranged close to the front 110_3 of the loudspeaker enclosure 110.
- The further chamber 140, in which MF or HF/MF is arranged, is consequently located in the front area of the loudspeaker enclosure 110, i.e. no longer on the (acoustic) level of the first and/or second chambers 120, 220, as is the case with the loudspeaker systems 100 and 200.
- The HF horn 130 and possibly the MF horn, e.g. formed by the funnel-shaped depression(s) (sound baffles 110_5 for MF, see FIG. 4), therefore have a substantially shorter length in the main direction of radiation than in the case of the loudspeaker system 100 or 200.
- The loudspeaker systems 300, 400 can also be actuated by signal processing having (just) two amplifier channels. In contrast to the loudspeaker systems 100, 200, HF/MF can be operated passively with LF1 (and LF2 in the case of the loudspeaker system 400) by one amplifier channel in this case, whereas the laterally radiating R-LF1 (and R-LF2 in the case of the loudspeaker system 400) are operated on a dedicated amplifier channel. Therefore, the loudspeaker systems 300 and 400 shown in FIGS. 3 and 4 likewise allow control of the directivity over the entire frequency range and also an increase in the directivity in the low frequency range by virtue of the laterally radiating R-LF1 (and R-LF2 in the case of the loudspeaker system 400). However, the lower installation depth of HF/MF (and the associated shorter HF/MF horn length(s) or lower depth of the funnel-shaped depression 110_5 for MF) means that the radiation behavior in the high and midrange frequency range cannot be controlled as exactly and the efficiency is lower than in the case of the loudspeaker systems 100, 200. Moreover, the power balance of the two amplifier channels is not as even as in the case of the loudspeaker systems 100, 200, since the amplifier channel that operates the more powerful bass sound sources LF1, LF2 additionally has to provide the power in the high and midrange frequency range for HF/MF.

Otherwise, the explanations pertaining to the loudspeaker systems 100 and 200 apply analogously for the loudspeaker systems 300 and 400, reference being made to the disclosure pertaining to FIGS. 1 and 2 to avoid repetition. In particular, the loudspeaker system 400 of FIG. 4 also has a completely symmetrical design in regard to a central vertical plane in the direction of the main direction of radiation.

The depth of the loudspeaker enclosure 110 (i.e. the enclosure dimension in the main direction of radiation) of all of the embodiments may be less than or equal to or greater than 40, 50, 60 or 70 cm, for example. The distance from LF1 to R-LF1 (or LF2 to R-LF2) measured in the main direction of radiation between the centers of the respective drivers may be less than or equal to or greater than 20, 30, 40, 50 or 60 cm, for example. The width of the loudspeaker enclosure 110 (i.e. the length of the rear wall 110_4) may be less than or equal to or greater than 80, 90, 100, 110, 120, 130, 140, 150 or 160 cm, for example. The height of the loudspeaker enclosure 110 (dimension perpendicular to the plane of the paper) may be less than or equal to or greater than 30, 40, or 50 cm, for example. Other values are likewise possible. The loudspeaker enclosure 110 may be embodied with or without bass reflex openings. By way of example, bass reflex openings (not depicted) may be provided on the front 110_3, e.g. in the region of the corners of the enclosure 110.

Figure 5:
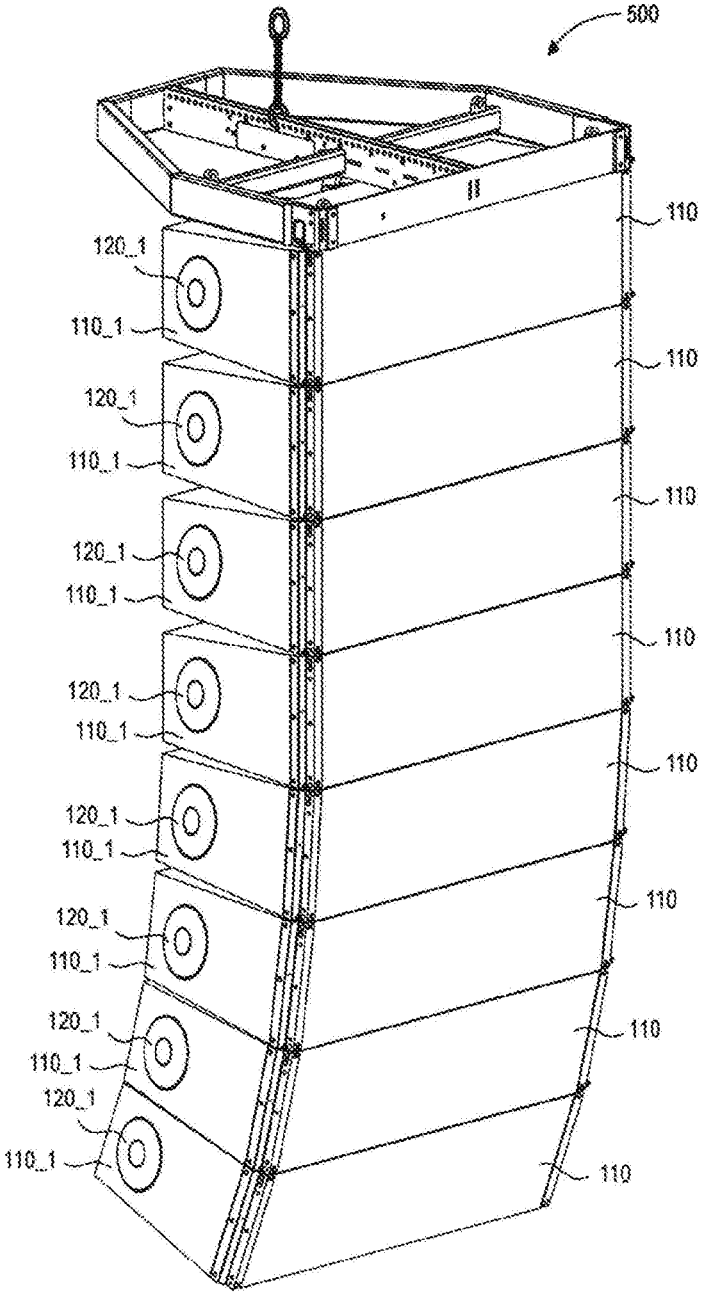
FIG. 5 is a schematic perspective view of a line array consisting of a plurality of loudspeaker boxes suspended beneath one another.

FIG. 5 shows what is known as a line array 500, in which loudspeaker systems having sound exit openings 120_1 at the side, as are depicted in FIGS. 1 to 4, for example, are arranged suspended beneath one another. The loudspeaker enclosure 110 of a loudspeaker system intended for a line array 500 has a shaping of the side walls 110_1, 110_2 that tapers toward the rear wall in order to allow the (increasing) curvature of the line array 500, which can be seen in FIG. 5.

The loudspeaker systems 100, 200, 300, 400 may also be standalone systems or other loudspeaker systems, however, that are not provided for the purpose of being arranged in a manner joined to other loudspeaker boxes and in an array. By way of example, the full range loudspeaker systems described here may also be stand loudspeakers, for example column loudspeakers.

Figure 6:
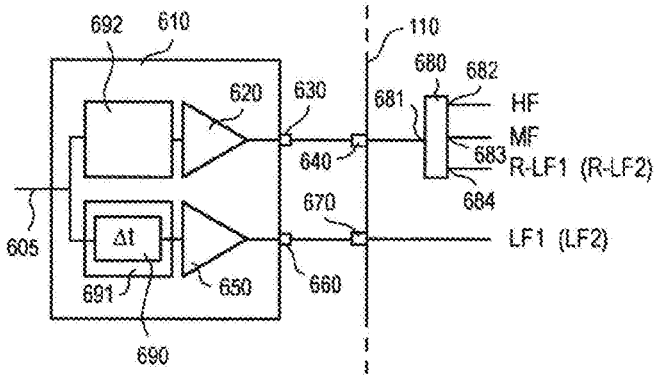
FIG. 6 is a schematic depiction of a first exemplary arrangement of electronic components of a loudspeaker system in and outside a loudspeaker box according to the first embodiment.
Figure 7:
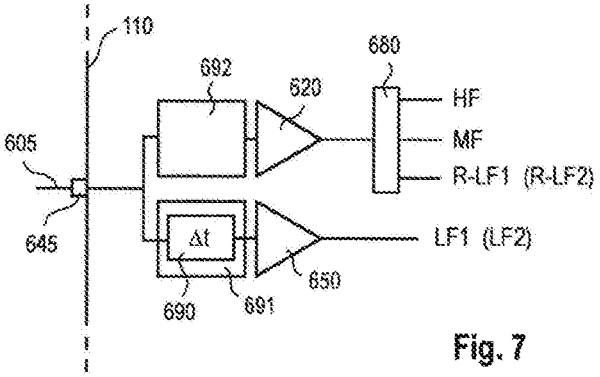
FIG. 7 is a schematic depiction of a second exemplary arrangement of electronic components of a loudspeaker system in and outside a loudspeaker box according to the first embodiment.
Figure 8:
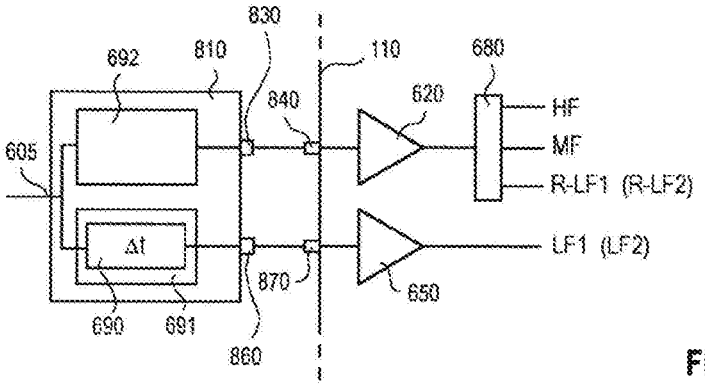
FIG. 8 is a schematic depiction of a third exemplary arrangement of electronic components of a loudspeaker system in and outside a loudspeaker box according to the first embodiment.

FIGS. 6, 7 and 8 are examples of the arrangement of electronic components of a loudspeaker system according to the disclosure according to the first embodiment, that is to say, by way of example, of the loudspeaker systems 100, 200 depicted in FIGS. 1 and 2. FIG. 6 depicts an audio signal circuit 610 that is external to the loudspeaker enclosure 110 and that has two amplifier channels. The reference symbol 620 denotes a power amplifier of the first amplifier channel and the reference symbol 650 denotes a power amplifier of the second amplifier channel.

An output 630 of the first amplifier channel of the audio signal circuit 610 is connected to a first transmission path of the loudspeaker box via a cable connection and an input 640 of the loudspeaker box, for example. The input 640 may be located on one of the walls of the loudspeaker enclosure 110 (for example on the rear wall 110_4), for example.

In an analogous manner, an output 660 of the second amplifier channel of the audio signal circuit 610 is connected e.g. via a further cable connection via an input 670 of the loudspeaker box to a second transmission path of the loudspeaker box, the input 670 likewise being able to be arranged on the loudspeaker enclosure 110 (e.g. rear wall 110_4). At the inputs 640, 670, analog audio signals are accepted.

The first transmission path comprises a (passive) frequency filter 680, arranged in or on the loudspeaker enclosure 110, whose input 681 is connected to the first input 640 of the loudspeaker box. The frequency filter 680 comprises a first output 682 that is connected to an input of HF, a second output 683 that is connected to an input of MF and a third output 684 that is connected to an input of R-LF1 and, if present, to an input of R-LF2 (3-way system). Provided that HF and MF are realized by a single wideband loudspeaker, the outputs 682 and 683 coincide (2-way system).

In the example depicted here, the second transmission path comprises the second input 670 of the loudspeaker box, which second input is connected to an input of LF1 and, if present, to an input of LF2.

The time delay for LF1 and if need be LF2 takes place, by way of example, in signal processing upstream of the second amplifier channel, i.e. upstream of the second power amplifier 650. A depiction shows a time delay element 690 in the analog signal path upstream of the power amplifier 650 of the second amplifier channel. The time delay element 690 may be realized, by way of example, in a digital signal processing circuit, particularly a DSP (digital signal processor) 691, in that case by using the internal memory in the DSP 691, for example. It is also possible for the time delay element 690 to use memory chips (not depicted) outside the DSP in order to realize the desired time delay in the second audio signal channel.

In the signal path upstream of the first amplifier channel (i.e. upstream of the first power amplifier 620), digital signal processing, e.g. in the form of a DSP 692, may likewise be arranged. The first audio signal channel, which comprises the DSP 692 and the power amplifier 620, and the second audio signal channel, which comprises the time delay element 690, the DSP 691 and the power amplifier 650, can be actuated by a common audio signal 605 that is provided by an audio signal source (not depicted), for example a microphone.

Another option for the arrangement of the cited electronic components is illustrated in FIG. 7. There, the time delay element 690, the two digital signal processing sections (e.g. DSPs 691, 692), the power amplifiers 620, 650 and the e.g. passive frequency filter 680 are arranged inside the loudspeaker box, i.e. in or on the loudspeaker enclosure 110. Such loudspeaker systems including integrated power amplifiers 620, 650 are also referred to as self-powered systems. The loudspeaker box can manage with a single input 645. The two transmission paths in a loudspeaker box are coupled to this input 645 and, in this exemplary embodiment, comprise the signal processing, the amplifier channels and the components already included in the example of FIG. 6.

For further features and properties of the components depicted in FIG. 7, reference is made to the description pertaining to FIG. 6.

FIG. 8 shows a further option for the arrangement of the cited components inside or outside the loudspeaker box of a self-powered system in which the power amplifiers 620, 650 are arranged inside the loudspeaker box (i.e. inside or on the loudspeaker enclosure 110). As in FIG. 6, the loudspeaker box again has two inputs 840, 870 for the two audio signal channels. The time delay element 690 is external and may be realized in a DSP 691, for example. In FIG. 8, the DSP 692 of the first audio signal channel is likewise external. By way of example, an external audio signal circuit 810 can include the digital signal processing sections e.g. in the form of DSPs 691, 692 and have outputs 860 and 830 at which, by way of example, digital audio signals are output and transmitted to the inputs 870 and 840 on the loudspeaker box.

Many and diverse variants of the arrangements depicted in FIGS. 6 to 8 are possible. By way of example, in FIG. 8, only the time delay element 690 in a "system processor" (not depicted), for example, may be connected upstream of the loudspeaker box (or an array of loudspeaker boxes), and the remainder of the channel-based signal processing in the form e.g. of the DSPs 691, 692 may be arranged inside the loudspeaker box, in a similar manner to that depicted in FIG. 7.

It is further pointed out that the time delay element 690 in all the examples may, in principle, also be arranged in the signal path downstream of the power amplifier 650 and could be realized there using a passive all-pass filter, for example. However, this solution does not appear to make sense for most applications on account of high power losses in the time delay element 690.

The electronic components included in the external audio signal circuit 610 may be arranged in a common (external) device or in physically distributed fashion, for example. "External" electronic components may be arranged over greater distances (for example several 10 or 100 m) away from the loudspeaker box (or the array of loudspeaker boxes), for example. In the case of self-powered systems with integrated power amplifiers (for example see the arrangements of FIGS. 7 and 8), the audio signal or the audio signals can also be transmitted to the loudspeaker boxes wirelessly, i.e. the inputs 605 or 840 and 870 can be realized by antennas and radio receivers in this case. The signal processing in the loudspeaker box or the array of loudspeaker boxes, for example including the selection of the time delay Δt, can be prescribed by an external central control unit (not depicted) by means of remote control (e.g. by radio), for example.

In all of the arrangements depicted in FIGS. 6, 7 and 8, the laterally radiating R-LF1 and possible R-LF2 are actuated passively together with HF/MF (i.e. the remainder of the full range frequency band), whereas the "actual" bass sound sources LF1 and possibly LF2 are operated via a separate audio channel.

Figure 9:
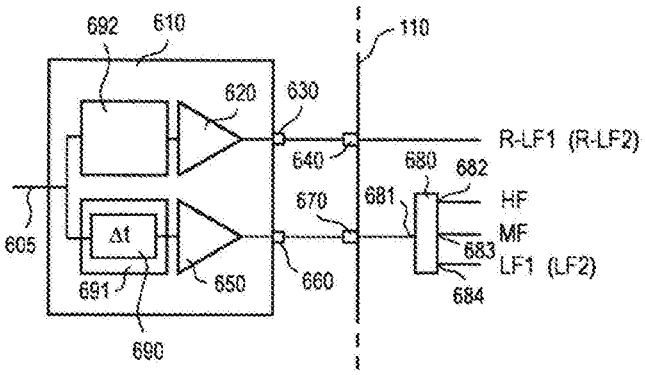
FIG. 9 is a schematic depiction of a first exemplary arrangement of electronic components of a loudspeaker system in and outside a loudspeaker box according to the second embodiment.
Figure 10:
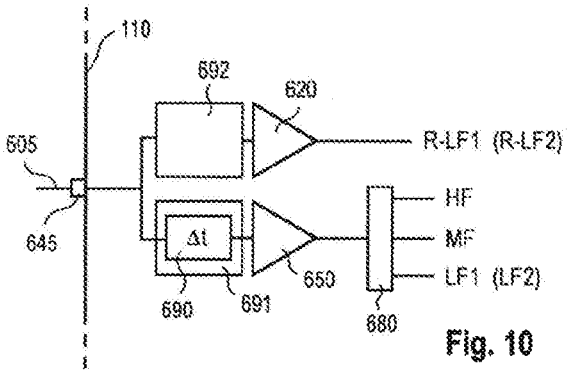
FIG. 10 is a schematic depiction of a second exemplary arrangement of electronic components of a loudspeaker system in and outside a loudspeaker box according to the second embodiment.
Figure 11:
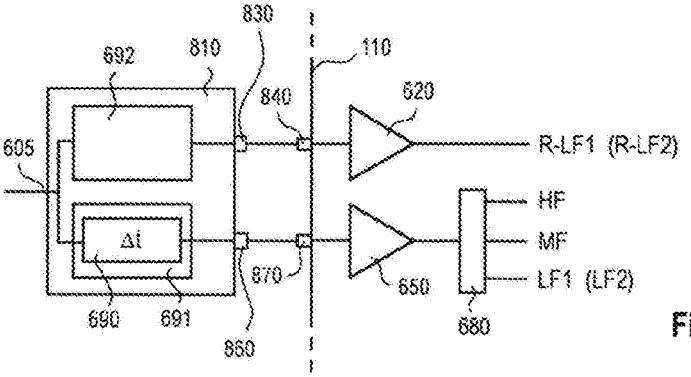
FIG. 11 is a schematic depiction of a third exemplary arrangement of electronic components of a loudspeaker system in and outside a loudspeaker box according to the second embodiment.

FIGS. 9 to 11 illustrate arrangements and connections between electronic components as can be used for loudspeaker systems of the second embodiment, i.e. the loudspeaker systems 300, 400 depicted in FIGS. 3 and 4, for example. The arrangements depicted in FIGS. 9, 10 and 11 differ from the arrangements depicted in FIGS. 6, 7 and 8 essentially in that instead of R-LF1 and possibly R-LF2, LF1 and possibly LF2 are now connected to the e.g. passive frequency filter 680, while the laterally radiating directivity bass sound sources R-LF1 and possibly R-LF2 are now operated by a dedicated audio signal channel; and the frequency filter 680 is now included in the second transmission path (which operates with the time delay), while the first transmission path supplies solely to the directivity sound sources R-LF1 and possibly R-LF2.

Otherwise, all of the features and properties described in relation to FIGS. 6 to 8 apply analogously for the arrangements depicted in FIGS. 9 to 11, so that reference can be made to the disclosure in relation to FIGS. 6 to 8 to avoid repetition.

Figure 12:
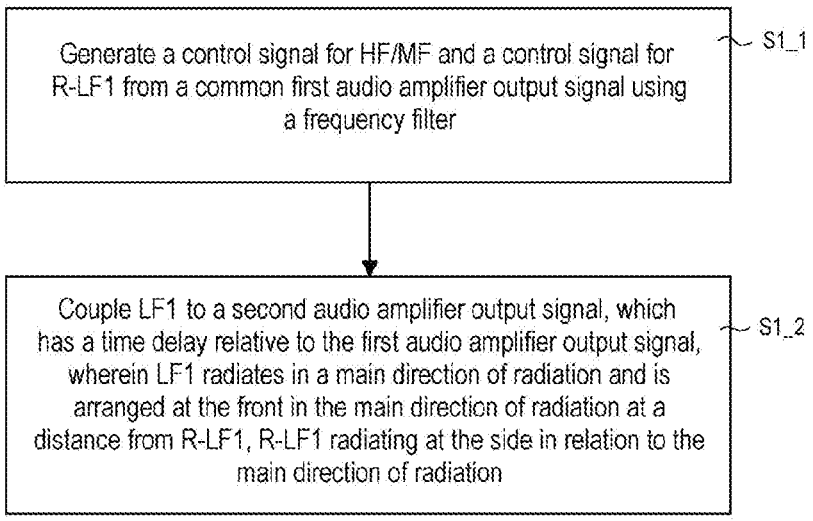
FIG. 12 is a flowchart for an exemplary method for operating a loudspeaker system according to the first embodiment.

FIG. 12 is a flowchart for an exemplary method for operating a loudspeaker system according to the first embodiment. At S1_1, a control signal (drive signal) for HF/MF and a control signal (drive signal) for R-LF1 are generated from a common first audio amplifier output signal using a, for example passive, frequency filter.

At S1_2, LF1 is coupled to a second audio amplifier output signal that has a time delay relative to the first audio amplifier output signal, wherein LF1 radiates in a main direction of radiation and is arranged at the front at a distance from R-LF1 in a main direction of radiation, and wherein R-LF1 radiates at the side of the main direction of radiation. In this case, HF/MF can likewise radiate in the main direction of radiation.

Figure 13:
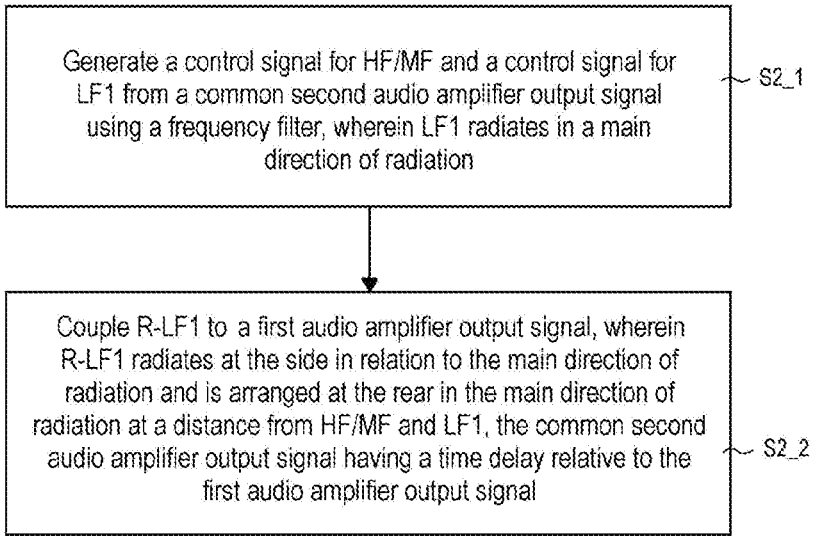
FIG. 13 is a flowchart for an exemplary method for operating a loudspeaker system according to the second embodiment.

An exemplary method for operating a loudspeaker system according to the second embodiment is depicted in FIG. 13 in the form of a flowchart. In this case, at S2_1, a control signal (drive signal) for HF/MF and a control signal (drive signal) for LF1 are generated from a common second audio amplifier output signal using a, for example passive, frequency filter, wherein LF1 radiates in a main direction of radiation.

At S2_2, R-LF1 is coupled to a first audio amplifier output signal, wherein R-LF1 radiates at the side of the main direction of radiation and is arranged at the rear at a distance from HF/MF and LF1 in the main direction of radiation. In this case, the common second audio amplifier output signal has a time delay relative to the first audio amplifier output signal. In this case, HF/MF can likewise radiate in the main direction of radiation.

A common feature of all of the embodiments is that a full range loudspeaker system that transmits over the entire audio frequency range (e.g. 40 Hz to 16 kHz), for example, can be embodied with a directivity that is controllable over the entire frequency range and that is possibly constant, for example, the inadequate directivity in the low frequency range on account of limited enclosure dimensions being increased in specific fashion by lateral bass radiation with a time offset that is possibly frequency dependent relative to the bass radiation in the main direction of radiation. In this case, all of the loudspeaker systems can manage with merely two audio signal channels and suitable, preferably passive, separation in the frequency range, with, particularly in the first embodiment, particularly good control of the sound routing in the HF/MF range and an even power balance on the amplifier channels being achievable.

The invention claimed is:

1. A loudspeaker system, comprising:

a loudspeaker enclosure having a front and a rear;

at least one first bass sound source, arranged in the loudspeaker enclosure, having a main direction of radiation at the front;

at least one treble and/or midrange sound source;

at least one first chamber of the loudspeaker enclosure having a first sound exit opening that is at the side in regard to the main direction of radiation;

at least one first directivity bass sound source that is arranged in the first chamber;

a first transmission path that is coupled to the treble and/or midrange sound source and the first directivity bass sound source; and a second transmission path that is coupled to the first bass sound source, wherein:

the first directivity bass sound source is arranged at a distance at the rear of the first bass sound source in regard to the main direction of radiation, and the treble and/or midrange sound source is arranged at approximately the same level as the first directivity bass sound source in regard to the main direction of radiation.

2. The loudspeaker system of claim 1, comprising:

a frequency filter in the first transmission path, outputs of the frequency filter being coupled to inputs of the treble and/or midrange sound source and of the first directivity bass sound source.

3. The loudspeaker system of claim 1, wherein the second transmission path is provided to transmit an audio signal that has a time delay in relation to an audio signal that is provided for the first transmission path.

4. The loudspeaker system of claim 1, comprising:

a high frequency (HF) horn and/or a midrange frequency (MF) horn that is coupled to the treble and/or midrange sound source.

5. The loudspeaker system of claim 4, wherein the HF horn and/or the MF horn has a length equal to or greater than 0.3 times the depth of the loudspeaker enclosure.

6. The loudspeaker system of claim 1, comprising:

a further chamber having a sound exit opening to the front of the loudspeaker enclosure, wherein a midrange sound source of the treble and/or midrange sound source is accommodated in the further chamber.

7. The loudspeaker system of claim 6, comprising:

a treble sound source of the treble and/or midrange sound source that is coupled to a high frequency (HF) horn and arranged coaxially in the main direction of radiation in relation to the midrange sound source.

8. A loudspeaker system, comprising:

a loudspeaker enclosure having a front and a rear;

at least one first bass sound source, arranged in the loudspeaker enclosure, having a main direction of radiation at the front;

at least one treble and/or midrange sound source;

at least one first chamber of the loudspeaker enclosure having a first sound exit opening that is at the side in regard to the main direction of radiation;

at least one first directivity bass sound source that is arranged in the first chamber;

a first transmission path that is coupled to the first directivity bass sound source; and a second transmission path that is coupled to the treble and/or midrange sound source and the first bass sound source, wherein the treble and/or midrange sound source is arranged at approximately the same level as the first bass sound source in regard to the main direction of radiation.

9. The loudspeaker system of claim 8, comprising:

a frequency filter in the second transmission path, outputs of the frequency filter being coupled to inputs of the treble and/or midrange sound source and of the first bass sound source.

10. The loudspeaker system of claim 8, wherein the second transmission path is provided to transmit an audio signal that has a time delay in relation to an audio signal that is provided for the first transmission path.

11. The loudspeaker system of claim 1, comprising:

at least one second bass sound source, arranged in the loudspeaker enclosure, having a main direction of radiation at the front;

at least one second chamber of the loudspeaker enclosure having a second sound exit opening that is at the side in regard to the main direction of radiation; and a second directivity bass sound source that is arranged in the second chamber.

12. The loudspeaker system of claim 11, wherein the first and second bass sound sources and/or the first and second directivity bass sound sources and/or the first and second chambers and/or the treble and/or midrange sound source are embodied symmetrically in relation to a plane that runs in the main direction of radiation.

13. The loudspeaker system of claim 4, wherein the HF horn and/or the MF horn has a length equal to or greater than 0.4 times a depth of the loudspeaker enclosure.

14. The loudspeaker system of claim 4, wherein the HF horn and/or the MF horn has a length equal to or greater than 0.5 times a depth of the loudspeaker enclosure.

* * * * *